US006505552B1

(12) United States Patent
Larson

(10) Patent No.: US 6,505,552 B1
(45) Date of Patent: Jan. 14, 2003

(54) SILK SCREEN TENSIONING SYSTEM

(76) Inventor: James D. Larson, 6323 83rd Ave. SE., Snohomish, WA (US) 98290-9208

( * ) Notice: Subject to any disclaimer, the term of this patent is extended or adjusted under 35 U.S.C. 154(b) by 0 days.

(21) Appl. No.: 09/588,039

(22) Filed: Jun. 5, 2000

Related U.S. Application Data

(63) Continuation-in-part of application No. 09/176,780, filed on Oct. 22, 1998, now Pat. No. 6,070,526.

(51) Int. Cl.[7] ..... B05C 17/08
(52) U.S. Cl. ..... 101/127.1; 38/102.4
(58) Field of Search ..... 101/127.1, 127, 101/128, 128.1; 38/102.6, 102.7, 102.4

(56) References Cited

U.S. PATENT DOCUMENTS 3,601,912 A 8/1971 Dubbs ..... 38/102.91
4,229,890 A * 10/1980 Dropinski ..... 38/102.1
5,443,003 A 8/1995 Larson ..... 101/127
5,488,901 A 2/1996 Hruska ..... 101/129
5,937,753 A 8/1999 McKeever ..... 101/127
6,113,088 A * 9/2000 Gakhar et al. ..... 269/139
6,185,802 B1 * 2/2001 Gruber et al. ..... 29/38 R

* cited by examiner

*Primary Examiner*—Ren Yan
*Assistant Examiner*—Kevin D. Williams
(74) *Attorney, Agent, or Firm*—Jensen & Puntigam, P.S.

(57) ABSTRACT

A method and apparatus for placing a predetermined tension on a silk screen, including a workstation where more than one screen may be stretched without the necessity of removing the previous screen or necessitating a physical movement of the operator.

5 Claims, 5 Drawing Sheets

SILK SCREEN TENSIONING SYSTEM

This application is a continuation-in-part of U.S. patent application Ser. No. 09/176,780 filed Oct. 22, 1998 now U.S. Pat. No. 6,010,526 in the name of James D. Larson.

TECHNICAL FIELD

This invention relates to the method and apparatus for quickly and easily placing a uniform and predetermined tension upon a silk-screen mounted to a roller frame for use in the silk-screen process, and more particularly to a system which allows an operator to place the screen material quickly and easily under a prescribed, predetermined uniform tension, and further allows an operator to tension and retension more than one screen at the same station without having to relocate the screen.

BACKGROUND OF THE INVENTION

Although the silk-screen process is a relatively uncomplex and straightforward process, it is highly competitive, and so therefore it is imperative that the screens be placed on the frame with a predictable uniform tension at a fairly rapid rate and with a minimum of waste of the screen material.

A major breakthrough in terms of reduction of waste and increase of productivity was the invention and utilization of the retensionable roller frame.

Another innovation which directly improves the efficiency of the silk-screening process while reducing the amount of waste was the utilization of precut fabric to incorporate the predicted flexure of the roller frame when placed under tension and the placement of border strips or edges along the precut fabric, such that the strips could simply be snapped into place on the roller frame and then the appropriate tension applied. Often the screen must rest for a period of time between tensioning steps to achieve the appropriate tension without the risk of tearing the fabric.

References known to the inventor which are pertinent to the present invention include:

U.S. Pat. No. 3,601,912 granted to Dubbs, Aug. 31, 1971, which discloses the use of a roller frame for use in the silk-screen process.

U.S. Pat. No. 5,443,003, granted to Larson, Aug. 22, 1995, teaches the use of an improved roller frame in conjunction with a precut fabric, to which an edge has been applied, for quickly snapping into the roller frame.

U.S. Pat. No. 5,488,901, granted to Hruska, Feb. 6, 1996, teaches the use of a hydraulic or pneumatic table for placing a predetermined tension upon a silk-screen stretched upon a roller frame.

U.S. Pat. No. 5,937,753 granted to McKeever, Aug. 17, 1999, teaches another method of utilizing a hydraulic or pneumatic cylinder to place a predetermined amount of tension upon a silk-screen fabric which has been attached to the sides of a roller frame.

SUMMARY OF THE INVENTION

With the above noted prior art in mind, it is an object of the present invention to provide a screen tensioning system which, while being of reasonable cost and simple to use, provides a tensioning system which permits a predictable and uniform tension to be placed upon a silk-screen fabric.

It is another object of the present invention to provide a system wherein an operator may quickly and easily attach a screen to a roller frame and then place the appropriate tension thereon.

Still yet another object of the present invention is to provide a silk-screen tensioning system wherein an individual may tension and retension more than one frame at a single station, without needing to remove the previously stretched frame.

BEST MODE FOR CARRYING OUT THE INVENTION

Figure 1:
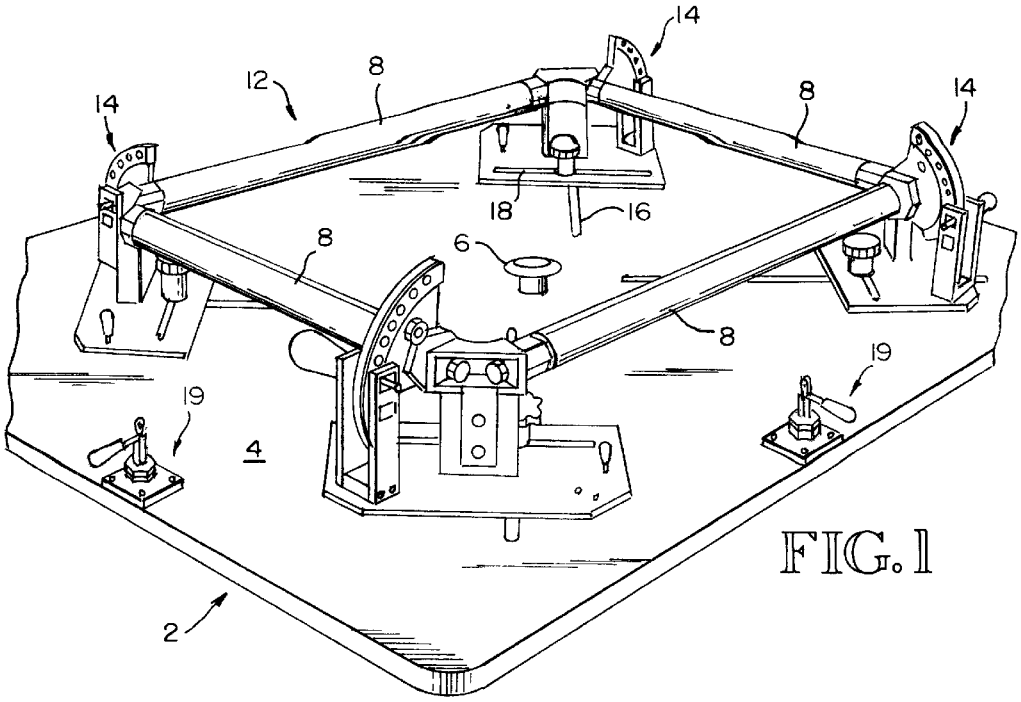
FIG. 1 is an isometric view of the tensioning system with the novel wrenches in place.

As seen in FIG. 1, there is shown a turntable 2 having a flat upper surface 4 rotatable about a center point 6 such that each of the sides 8 of the roller frame 12 may be worked at from the same position of the operator. It is to be noted that each of the corners of roller frame 12 is supported by a tensioning station 14 to be described in greater detail hereinafter. It is also to be noted that the tensioning station 14 is adjustably mounted to the turntable 2 since it is a movable in both slots 16 and 18 to accommodate different size roller frames. A toggle clamp 19 is provided along each side to lock the turntable to its base and prevent rotation.

Figure 2:
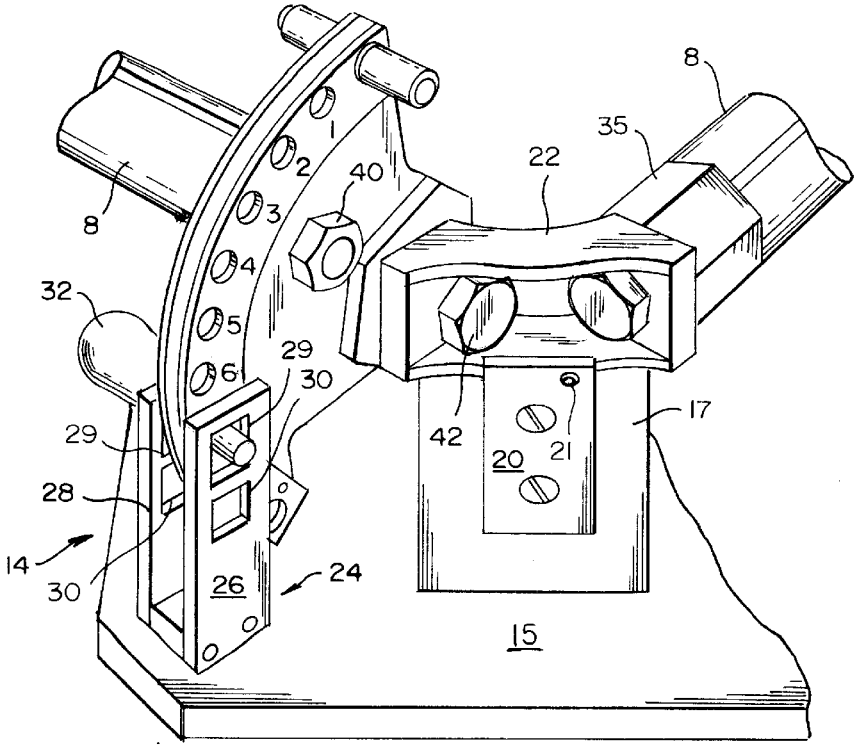
FIG. 2 is an enlarged view of the wrenching system.

As seen in FIG. 2 each of the wrenching stations 14 includes a platform 16 which as noted hereinabove is adjustably secured to the turntable 2 to accommodate different sized frames, a frame support tower 18 including positioning means 20 with adjusting screw 21 for locking the corner 22 of the stretching frame in position during the tensioning process. Likewise secured to the platform 15 is a locking tower 24 including a pair of spaced parallel uprights 26, 28 having aligned openings 29 and 30 therethrough for receiving a locking pin 32 as explained hereinafter. A wrench head (see FIG. 3) includes a hexagonal opening 34 to cooperate with the flats 3 (FIG. 2) at the ends of the roller frame sides 8 to permit the tensioning of the screen which has been mounted thereto.

The main body portion of the wrench 36 is integral with the jaws 34 and is generally arcuate in shape and includes a plurality of circumferentially aligned bores 38 which as seen in FIG. 2 interact with the openings 29, 30 in the tower 24 to hold the wrench and the side 8 to which is secured in position by placing the appropriate tension on the screen which is attached thereto. The bores 38 are sequentially numbered correlating to tension and allowing an operator to predetermine and control tension related to the fabric.

Figure 3:
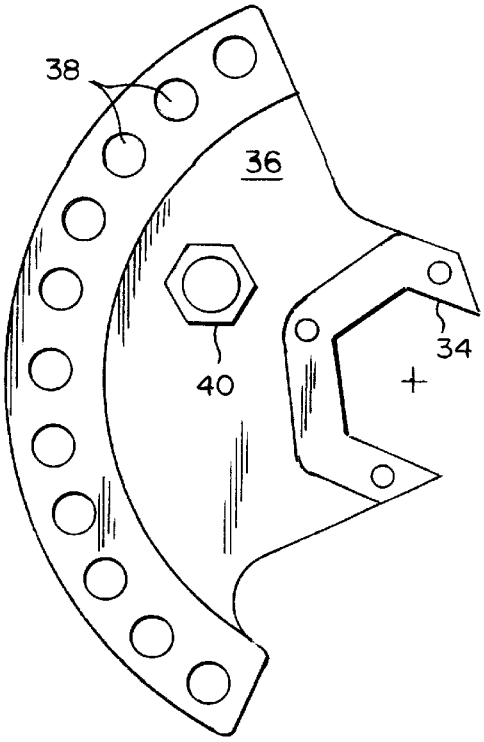
FIG. 3 is an elevation of view of the wrench head.

Also as seen in FIG. 3 is a hexagonal head 40 which is of the same size as the tightening nuts 42 at the ends of the arms such that an operator will place the wrench on nut 40, tighten the fabric to the appropriate tension as indicated by the indices on the outer rim of the wrench 34, place the pin 32 in position in the tower 24 and tighten the nut 42 such that when the appropriate tension has been reached the wrench is removed and the screen is placed in use. The combination of the support tower 18 and the wrench 34 when secured with pin 32 locks the frame in place on the turntable.

Figure 4:
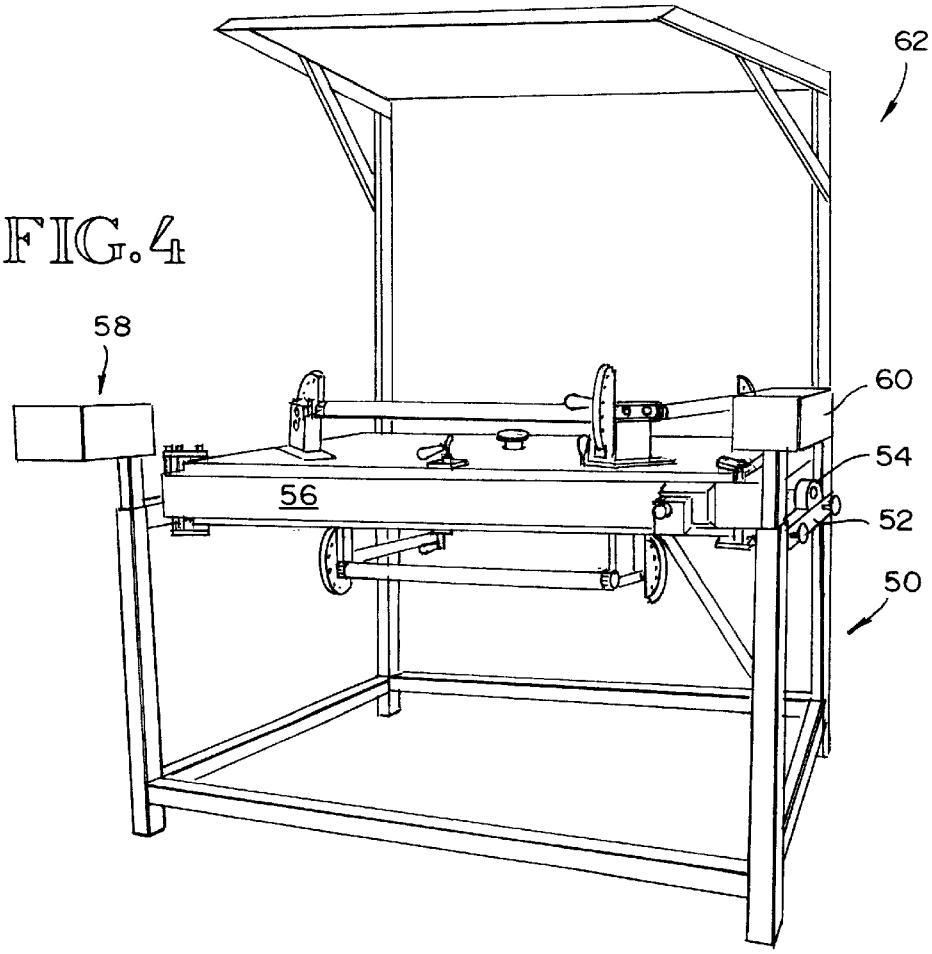
FIG. 4 is an isometric representation of a station having dual turntables.

Reference is now had to FIG. 4 wherein there is shown a generally rectangular framework 50 having mounted thereon a pair of opposing horizontal support elements 52 supporting trunnions 54 which support a horizontal axle (not shown). Mounted for rotation about the horizontal axle is a platform member 56 to which is secured a pair of back-to-back turntables as described with respect to FIG. 1. Likewise shown on this figure is a pair of receptacles 58, 60 to support tools or other elements used in the stretching of fabric. Extending above the rectangular framework 50 is an upwardly extending canopy-like member 62 from which precut and splined screens to be stretched may be stored.

Figure 5:
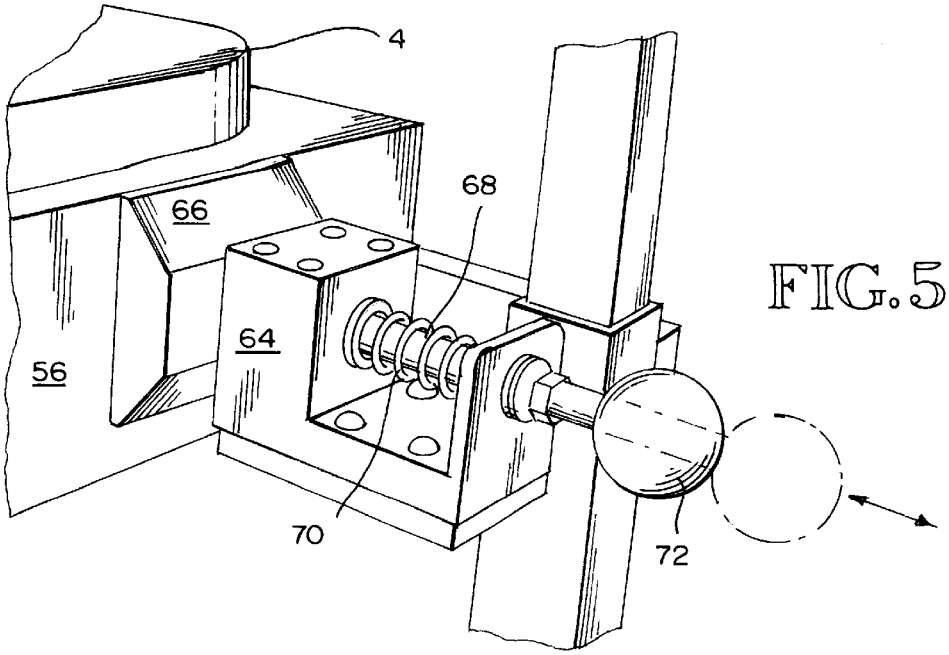
FIG. 5 is an enlarged view of the turntable locking mechanism.

Referring now to FIG. 5, it can be seen that the main platform 56 is locked into the horizontal position for stretching the screen by means of a spring-biased locking mechanism including a main body portion 64 having a horizontal bore therethrough and a locking plate 66 having a partial bore therein. A locking shaft 68 surrounded by compression spring 70 is moved to release by handle 72, is normally urged toward the locked position. The turntable is prevented from rotation by toggle clamp 19 and the turntable is held against the base even when not on top by a hold down plate as described hereinafter.

Figure 6:
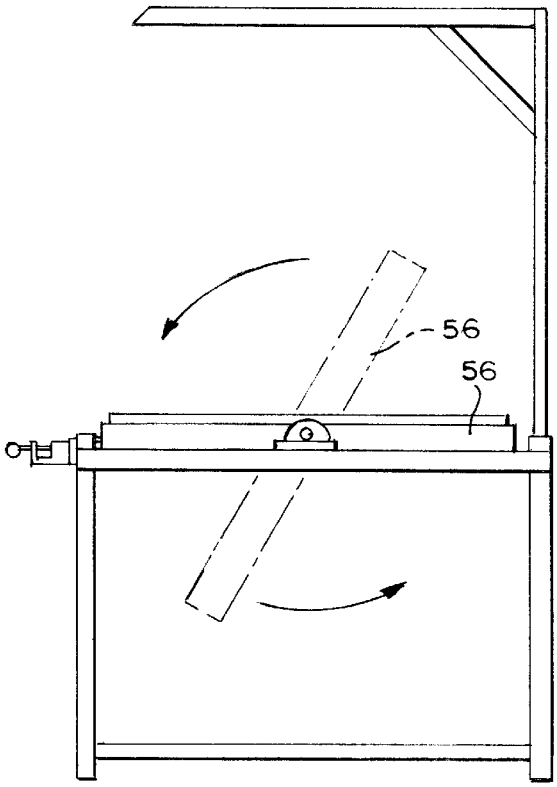
FIG. 6 is a side elevation view showing the apparatus of FIG. 4 being moved from one operational position to another.

As seen at FIG. 6 when the locking mechanism is released the apparatus is allowed to rotate about its horizontal axis exposing the second stretching apparatus at the same station.

Figure 7:
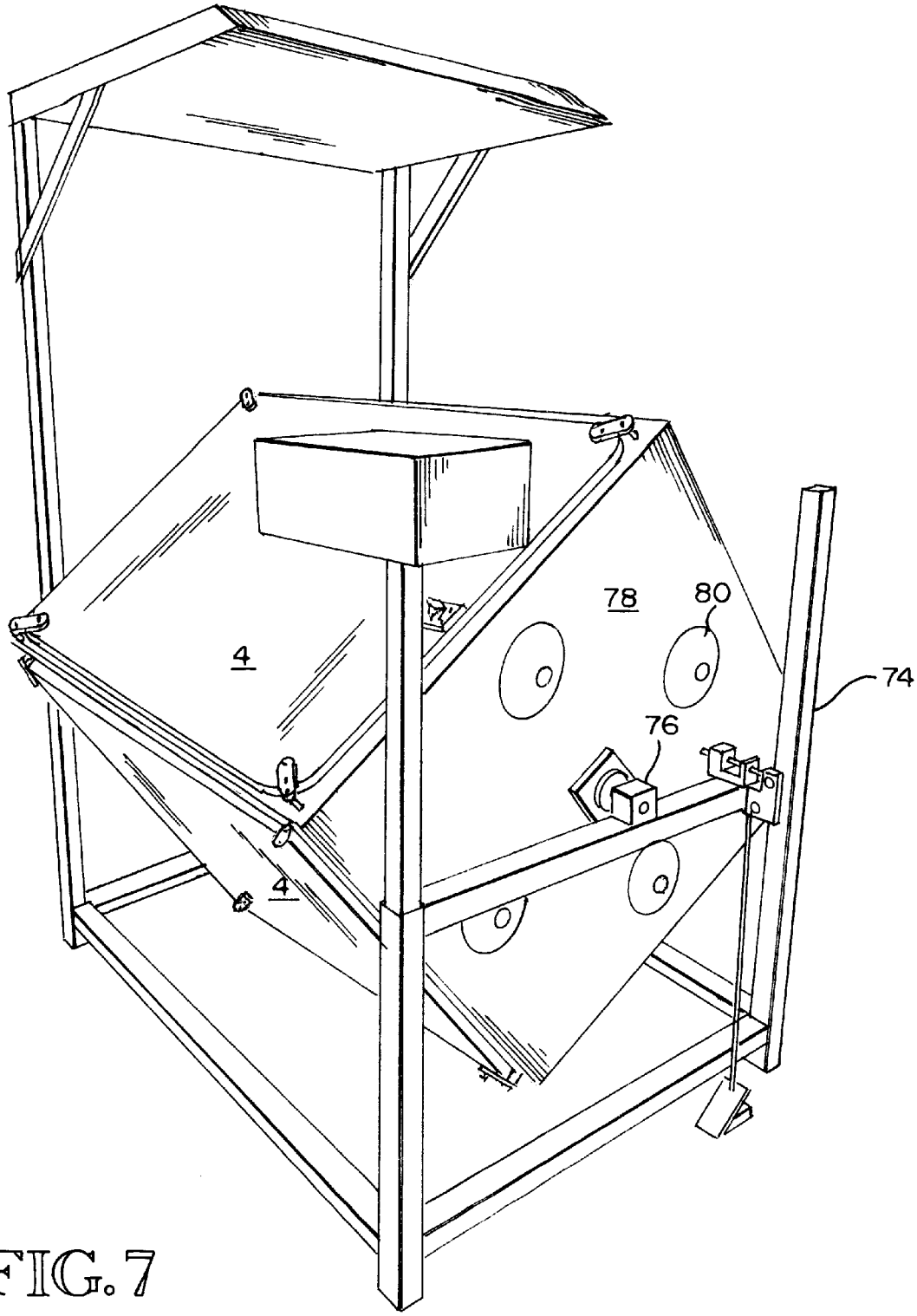
FIG. 7 is an isometric view of the stretching system utilizing four turntables.

Referring now to FIG. 7, again a rectangular framework 74 supporting a horizontal axle, not shown, supported by trunion 76 about which a rectangular support element 78 is rotated, said rectangular element including four turntables as described with respect to FIG. 1 on support elements 4. As further seen in this view a foot operated locking mechanism similar to that shown in FIG. 5 is utilized in conjunction with the shaft receiving lock plate 80 to hold the device in position for working on the screen.

Figure 8:
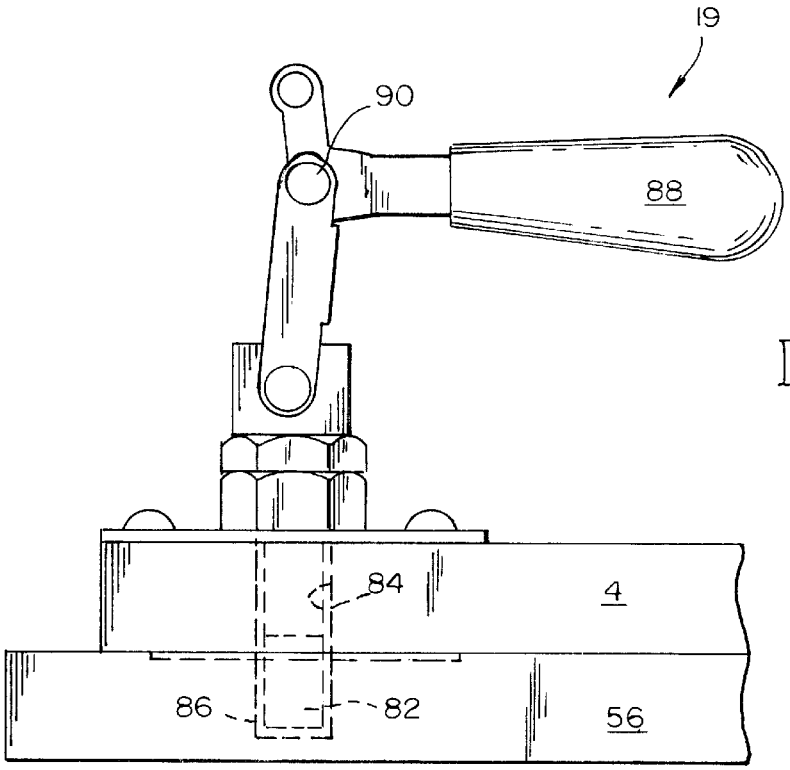
FIG. 8 is an elevational view of a toggle clamp for securing the turntable against rotation.

As seen in FIG. 8 the toggle clamp 19 is mounted to turntable 4 mounted for full rotation on base member 56. The toggle itself includes an axially movable locking rod 82 which extends through a bore 84 in turntable 4 and into a hollow 86 into the base plate 56 such that when the rod is in a locked position the turntable 4 cannot move relative to the base 56. The handle 88 moves from the unlocked position as shown wherein the rod 82 is retracted to the lock position by rotating the handle about point 90 extending the rod into the opening within the base.

Figure 9:
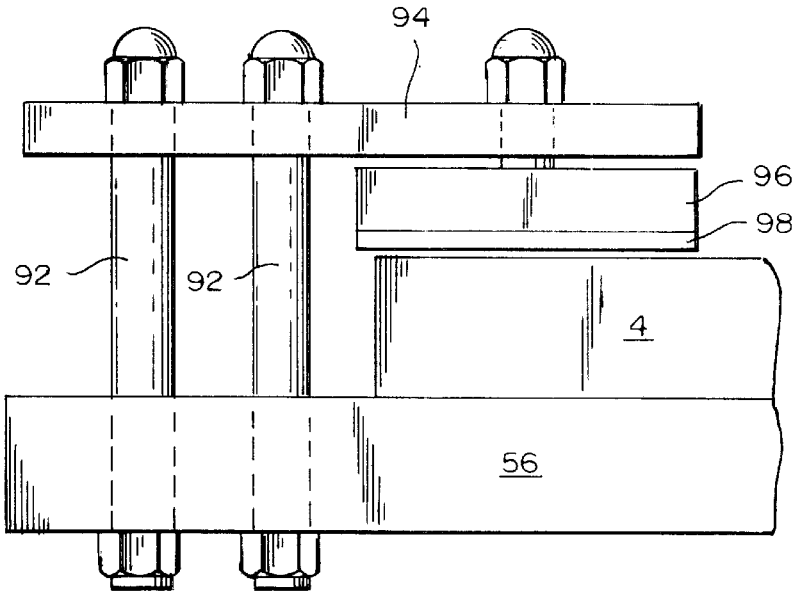
FIG. 9 is an elevational view of a held down plate for holding the turntable against the base.

As stated hereinabove, when the apparatus is utilized for stretching two or more screens, the screen is occasionally in an inverted position and therefore a hold inverted position and therefore a hold down plate is used as seen in FIG. 9. A pair of threaded elements 92 secure the hold down plate 94 at a predetermined distance from the base 56. The plate 94 extends toward the center of the turntable from the edge of the plate overlying the turntable 4 and is secured there to an adjustable stop member 96 having a nylon pad or the like 98 on its lower portion such that when the turntable is in the inverted position the turntable will rest against the nylon element 98. It is also to be understood that a low friction element is placed between the turntable 4 and the base plate 56.

Thus, as can be seen, the present invention provides a silk-screen stretching or tensioning system wherein an operator can quickly and easily place the silk-screen at the appropriate tension, and further allows the operator to tension all four sides of the screen without having to move, and further allows the operator to tension and retension more than one screen at the same station without having to remove one before tensioning a second, third or fourth.

What is claimed is:

1. Silk screen tensioning station, comprising:

a frame supporting a horizontal axle;

at least two turntables secured to said axle along spaced lines parallel thereto;

each of said at least two turntables including adjustable means for securing a rectangular roller frame thereto; and means for tensioning a silkscreen secured to the roller frame whereby more than one silkscreen may be placed under tension at the same station.

2. A silkscreen tensioning station as in claim 1, wherein there are four turntables.

3. A silkscreen tensioning station as in claim 1, wherein the axle is locked in position when one of the turntables is in an upwardly facing horizontal position.

4. A silkscreen tensioning station as in claim 1, wherein the turntable is locked in position when one side of the rectangular roller frame is parallel to said axle.

5. A tensioning means for use with a retensionable rectangular silk screen frame, comprising:

a support for each corner of the frame;

locking means adjacent each corner support;

wrench means including an inner jaw portion to interact with a similarly configured end section of the side of the silk screen frame; and said locking means including an index means having at least one vertical element adjacent the corner support, sid vertical element having discrete stop positions which receive a locking pin to allow an operator to secure the wrench means to the locking means at a predetermined position by securing the wrench means to the vertical element at a stop position.

* * * * *